US008974142B2

(12) United States Patent
Buehler et al.

(10) Patent No.: US 8,974,142 B2
(45) Date of Patent: Mar. 10, 2015

(54) CRASH CUSHION

(75) Inventors: Michael J. Buehler, Roseville, CA (US); Aaron J. Cox, Roseville, CA (US)

(73) Assignee: Energy Absorption Systems, Inc., Dallas, TX (US)

( * ) Notice: Subject to any disclaimer, the term of this patent is extended or adjusted under 35 U.S.C. 154(b) by 66 days.

(21) Appl. No.: 13/290,550

(22) Filed: Nov. 7, 2011

(65) Prior Publication Data

US 2012/0121325 A1 May 17, 2012

Related U.S. Application Data

(60) Provisional application No. 61/413,798, filed on Nov. 15, 2010.

(51) Int. Cl.
*E01F 15/00* (2006.01)
*E01F 15/14* (2006.01)

(52) U.S. Cl.
CPC ..... *E01F 15/146* (2013.01)
USPC ..... 404/6; 404/10

(58) Field of Classification Search
USPC ..... 404/6, 9, 10; 256/13.1
See application file for complete search history.

(56) References Cited

U.S. PATENT DOCUMENTS 2,088,087 A 7/1937 Hudson
3,112,046 A 11/1963 Szekely
3,643,924 A 2/1972 Fitch
3,674,115 A 7/1972 Young et al.
3,680,662 A 8/1972 Walker et al.
3,693,940 A 9/1972 Kendall et al.
3,768,781 A 10/1973 Walker et al.
3,802,135 A * 4/1974 Weichenrieder ..... 52/98
3,845,936 A 11/1974 Boedecker, Jr. et al.
3,856,268 A 12/1974 Fitch (Continued)

FOREIGN PATENT DOCUMENTS

DE 3106694 A1 9/1982
DE 3809470 A1 10/1989

(Continued)

OTHER PUBLICATIONS

International Search Report for International Application No. PCT/US2011/060344, dated Jun. 8, 2012, 3 pages.

(Continued)

*Primary Examiner* — Matthew D Troutman
(74) *Attorney, Agent, or Firm* — Brinks Gilson & Lione

(57) ABSTRACT

A crash cushion includes a plurality of resilient, self-restoring tubes each having a center axis and an interior surface. At least some of the tubes are positioned such that respective ones of the center axes are spaced apart in a longitudinal direction. The center axis of at least one tube is substantially perpendicular to a longitudinal axis extending in the longitudinal direction, with the tube defining a diametral plane intersecting and oriented substantially perpendicular to the longitudinal axis. The center axis of the tube lies in the diametral plane. One or more segments are positioned in the tube, with the segments, or portions thereof, disposed on opposite sides of the interior surface of the tube. Each of the segments or portions is symmetrically secured to the tube relative to the diametral plane, with the tube being substantially open between the opposing segments. Various methods of using and assembling the crash cushion are also provided.

23 Claims, 8 Drawing Sheets

(56) References Cited

U.S. PATENT DOCUMENTS

| | | | | |
|---|---|---|---|---|
| 3,880,404 | A | 4/1975 | Fitch | |
| 3,919,380 | A | 11/1975 | Smarook et al. | |
| 3,982,734 | A | 9/1976 | Walker | |
| 4,084,914 | A | 4/1978 | Humphrey et al. | |
| 4,090,694 | A * | 5/1978 | Vincent | 256/13.1 |
| 4,126,403 | A * | 11/1978 | Sweeney et al. | 403/2 |
| 4,190,275 | A | 2/1980 | Mileti | |
| 4,200,310 | A | 4/1980 | Carney, III | |
| 4,307,973 | A | 12/1981 | Glaesener | |
| 4,321,989 | A | 3/1982 | Meinzer | |
| 4,352,484 | A | 10/1982 | Gertz et al. | |
| 4,399,980 | A | 8/1983 | Van Schie | |
| 4,407,484 | A | 10/1983 | Meinzer | |
| 4,452,431 | A | 6/1984 | Stephens et al. | |
| 4,583,716 | A | 4/1986 | Stephens et al. | |
| 4,596,489 | A | 6/1986 | Mariol et al. | |
| 4,635,981 | A | 1/1987 | Friton | |
| 4,645,375 | A | 2/1987 | Carney, III | |
| 4,674,911 | A | 6/1987 | Gertz | |
| 4,711,481 | A | 12/1987 | Krage et al. | |
| 4,723,758 | A | 2/1988 | Gehrig | |
| 4,784,515 | A | 11/1988 | Krage et al. | |
| 4,815,565 | A | 3/1989 | Sicking et al. | |
| 4,844,213 | A | 7/1989 | Travis | |
| 5,011,326 | A | 4/1991 | Carney, III | |
| 5,054,954 | A | 10/1991 | Cobb et al. | |
| 5,112,028 | A | 5/1992 | Laturner | |
| 5,125,762 | A | 6/1992 | Strassil | |
| 5,238,228 | A * | 8/1993 | Moon | 256/13.1 |
| 5,248,129 | A | 9/1993 | Gertz | |
| 5,273,371 | A * | 12/1993 | Hugron | 404/10 |
| 5,314,261 | A * | 5/1994 | Stephens | 404/6 |
| 5,316,815 | A * | 5/1994 | Tripp | 428/66.6 |
| 5,403,112 | A | 4/1995 | Carney, III | |
| 5,429,449 | A | 7/1995 | Baatz | |
| 5,483,917 | A | 1/1996 | Walker | |
| 5,487,619 | A | 1/1996 | Winebrenner | |
| 5,607,252 | A | 3/1997 | Tischer | |
| 5,718,413 | A | 2/1998 | Nagler | |
| 5,733,062 | A | 3/1998 | Oberth et al. | |
| 5,746,419 | A | 5/1998 | McFadden et al. | |
| 5,775,675 | A | 7/1998 | Sicking et al. | |
| 5,797,592 | A | 8/1998 | Machado | |
| 5,823,584 | A | 10/1998 | Carney, III | |
| 5,851,005 | A | 12/1998 | Muller et al. | |
| 5,868,521 | A | 2/1999 | Oberth et al. | |
| 5,875,875 | A | 3/1999 | Knotts | |
| 5,957,435 | A | 9/1999 | Bronstad | |
| 6,017,602 | A * | 1/2000 | Baker et al. | 428/36.9 |
| 6,024,341 | A | 2/2000 | Gertz | |
| 6,076,871 | A | 6/2000 | Jarvis et al. | |
| 6,082,926 | A | 7/2000 | Zimmer | |
| 6,092,959 | A | 7/2000 | Leonhardt et al. | |
| 6,095,716 | A | 8/2000 | Kulp et al. | |
| 6,116,805 | A | 9/2000 | Gertz | |
| 6,126,144 | A | 10/2000 | Hirsch et al. | |
| 6,149,134 | A * | 11/2000 | Bank et al. | 256/13.1 |
| 6,168,346 | B1 | 1/2001 | Ernsberger | |
| 6,179,516 | B1 | 1/2001 | Ivey et al. | |
| 6,203,079 | B1 | 3/2001 | Breed | |
| 6,220,575 | B1 | 4/2001 | Lindsay et al. | |
| 6,293,727 | B1 | 9/2001 | Albritton | |
| 6,308,809 | B1 | 10/2001 | Reid et al. | |
| 6,340,268 | B1 | 1/2002 | Alberson et al. | |
| 6,375,385 | B1 | 4/2002 | Kennedy | |
| 6,427,983 | B1 | 8/2002 | Leonhardt et al. | |
| 6,461,076 | B1 | 10/2002 | Stephens et al. | |
| 6,533,250 | B2 | 3/2003 | Arthur | |
| 6,536,985 | B2 | 3/2003 | Albritton | |
| 6,536,986 | B1 * | 3/2003 | Anghileri et al. | 404/6 |
| 6,551,010 | B1 | 4/2003 | Kiedaisch et al. | |
| 6,554,529 | B2 | 4/2003 | Stephens et al. | |
| 6,623,204 | B2 | 9/2003 | Buehler | |
| 6,637,971 | B1 | 10/2003 | Carney, III et al. | |
| 6,811,144 | B2 | 11/2004 | Denman et al. | |
| 6,863,467 | B2 | 3/2005 | Buehler et al. | |
| 6,866,284 | B2 | 3/2005 | Carlsson | |
| 6,905,281 | B2 * | 6/2005 | Kang | 404/6 |
| 7,037,029 | B2 | 5/2006 | Buehler et al. | |
| 7,112,004 | B2 | 9/2006 | Alberson et al. | |
| 7,597,501 | B2 | 10/2009 | Alberson et al. | |
| 7,811,026 | B1 * | 10/2010 | Kulp et al. | 404/10 |
| 7,866,914 | B2 * | 1/2011 | Kulp et al. | 404/10 |
| 2003/0168650 | A1 | 9/2003 | Alberson et al. | |
| 2004/0079931 | A1 * | 4/2004 | Climente | 256/13.1 |
| 2005/0111913 | A1 * | 5/2005 | Riker | 404/9 |
| 2007/0140790 | A1 * | 6/2007 | Lotsberg | 404/6 |
| 2008/0181722 | A1 | 7/2008 | McKenney et al. | |

FOREIGN PATENT DOCUMENTS

| | | | |
|---|---|---|---|
| FR | 2691124 | A1 | 11/1993 |
| WO | WO 93-23626 | A | 11/1993 |

OTHER PUBLICATIONS

Written Opinion of the International Searching Authority for International Application No. PCT/US2011/060344, dated Jun. 8, 2012, 7 pages.

"QuadGuard®, A Proven-Effective Crash Cushion", *Energy Absorption Systems*, Inc., 2000, pp. 1-37.

"QuadGuard®, Family of Crash Cushions", *Energy Absorption Systems*, Inc., Aug. 1997.

"QuadGuard®, Elite Crash Cushion System", Energy Absorption System, Inc., www.energyabsorption.com, © 2010, 2 pages.

"React 350® Impact Attenuator", Energy Absorption System, Inc., www.energyabsorption.com, © 2010, 2 pages.

"Saving Lives by Design", *Energy Absorption Systems*, Inc., pp. 1-15, 1998.

Figures 1A, 1B and 2 from present U.S. Appl. No. 13/290,550, 2 pages.

* cited by examiner 2
46
58
72
5
50
52
70
60
24
56
54
14
26
74
92
190

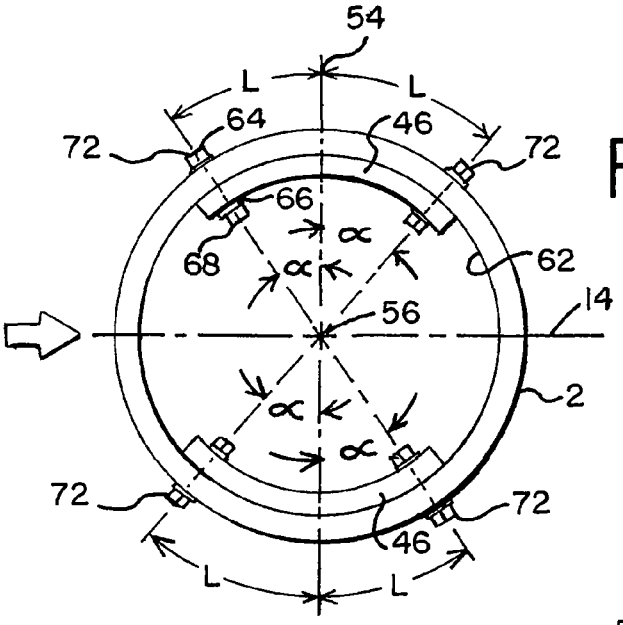
FIG. 9
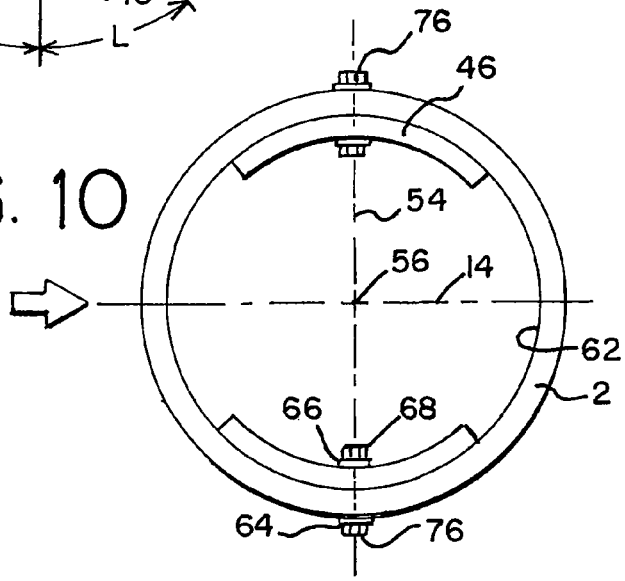
FIG. 10
FIG. 11
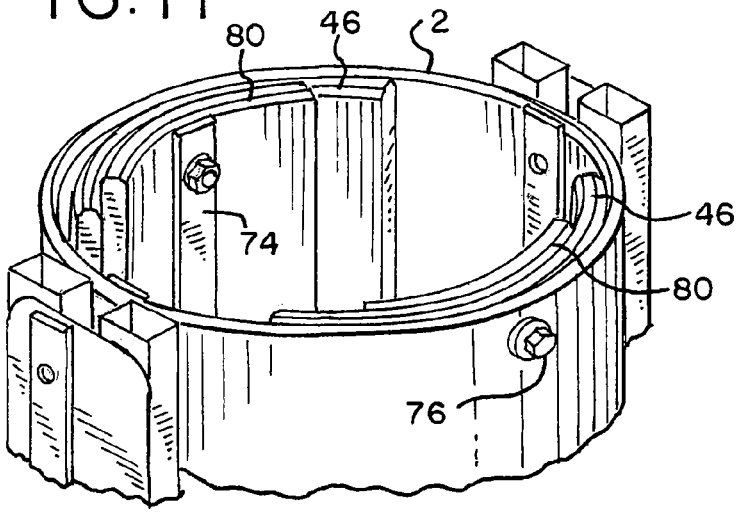

GRAPH OF ENERGY ABSORPTION OF VARIOUS CONFIGURATIONS OF TUBES.

GRAPH OF FORCE VS. DISTANCE OF VARIOUS CONFIGURATIONS OF REACT CYLINDERS, NORMALIZED TO 12 INCH HEIGHT.

CRASH CUSHION

This application claims the benefit of U.S. Provisional Application 61/413,798, filed Nov. 15, 2010, the entire disclosure of which is hereby incorporated herein by reference.

FIELD OF THE INVENTION

The present invention relates generally to a crash cushion, and in particular, to a crash cushion configured with at least one tube reinforced with a resilient segment.

BACKGROUND

Crash cushions may be used alongside highways in front of obstructions such as concrete walls, toll booths, tunnel entrances, bridges and the like so as to protect the drivers of errant vehicles. Various types of crash cushions may be configured with a plurality of energy absorbing elements, such as an array of resilient, self-restoring tubes, which facilitate the ability to reuse the crash cushion after an impact. The tubes 2 may be exposed, as configured for example in the REACT 350® impact attenuator (FIGS. 1A and 1B; see also U.S. Pat. No. 6,554,429) manufactured by Energy Absorption Systems, Inc., the assignee of the current application, or disposed within bays 4 defined by a plurality of diaphragms 6 and fender panels 8 extending alongside the diaphragms, as shown for example in the QUADGUARD® Elite crash cushion (FIG. 2), also manufactured by Energy Absorption Systems, Inc. In these types of systems, the tubes may be made of high density polyethylene. As shown for example in U.S. Pat. No. 6,554,529, some of the tubes incorporated into such crash cushions may be configured with a compression element disposed inside the tube so as to resist compression during a lateral impact. The compression element may be secured to the tube with a hinge portion. The compression elements may limit the total compression stroke of the tube in which they are deployed during an axial impact, and further are used in connection with systems having a width defined by more than one row of tubes.

In order to meet certain crash test standards set forth in the National Cooperative Highway Research Program Report 350 (NCHRP-350), including without limitation the Test Level 3 (TL-3) requirements, some crash cushions may require a minimum overall length or a minimum number of tubes so as to satisfy the energy dissipation requirements. These parameters may add to the overall cost of the system, and/or may limit the ability to deploy the system in certain environments having various spatial constraints. Thus, the need remains for reusable crash cushions that meet the NCHRP-350 requirements, but are relatively short in length.

SUMMARY

The present invention is defined by the following claims, and nothing in this section should be considered to be a limitation on those claims.

In one aspect, one embodiment of a crash cushion includes a plurality of resilient, self-restoring tubes each having a center axis and an interior surface. At least some of the tubes are positioned such that respective ones of the center axes are spaced apart in a longitudinal direction. The center axis of at least one tube is substantially perpendicular to a longitudinal axis extending in the longitudinal direction, with the tube defining a diametral plane intersecting and oriented substantially perpendicular to the longitudinal axis. The center axis of the tube lies in the diametral plane. A pair of segments are positioned in the tube, with the segments disposed on opposite sides of the interior surface of the tube. Each of the segments is symmetrically secured to the tube relative to the diametral plane, with the tube being substantially open between the opposing segments. Various methods of using and assembling the crash cushion are also provided.

In another aspect, one embodiment of the crash cushion includes at least one resilient segment having portions thereof disposed on opposite sides of the interior of at least one tube. The segment may be configured as a C-shaped section having opposite end portions defining the opposing portions.

The various embodiments of the crash cushion, and the methods for the use and assembly thereof, provide significant advantages over other crash cushions. For example and without limitation, the crash cushion may be made shorter and more compact while the capacity to meet crash test standards defined under NCHRP-350. In this way, the crash cushion may be deployed in various situations requiring a relatively short footprint. Conversely, a crash cushion of the same length may be constructed to absorb a greater amount of energy. In either case, the crash cushion may be made at a reduced cost, with less materials, greater portability and easier reconfigurability after a crash. For example and without limitation, the use of segments allows for the increased energy absorption of individual cylinders, or tubes, thereby yielding an opportunity to absorb greater energy per unit weight of material. At the same time, the tube may be made of a thinner material, which undergoes less strain at the outer circumferential portions thereof (i.e., outer fibers), which correlates to less permanent deformation.

In addition, the segments provide for an inexpensive and easy way to "tune" the crash cushion for various energy absorbing scenarios. Segments of different thicknesses, lengths (circumferential) and heights (axial length) may be selected depending on the desired cost efficiency, amount of energy to be absorbed, or the shape of the force/deflection curve. Likewise, the number and types of openings, and fastening devices, may be altered to provide different energy absorbing characteristics.

The foregoing paragraphs have been provided by way of general introduction, and are not intended to limit the scope of the following claims. The various preferred embodiments, together with further advantages, will be best understood by reference to the following detailed description taken in conjunction with the accompanying drawings.

BRIEF DESCRIPTION OF THE DRAWINGS

FIG. 9 is an end view of one embodiment of a tube with a pair of segments applied thereto.

FIG. 10 is an end view of another embodiment of a tube with a pair of segments applied thereto.

FIG. 11 is a partial, perspective view of an alternative embodiment of a tube.

DETAILED DESCRIPTION OF THE PRESENTLY PREFERRED EMBODIMENTS

It should be understood that the term "plurality," as used herein, means two or more. The term "longitudinal," as used herein means of or relating to length or the lengthwise direction 10 of the crash cushion, or assembly thereof. The term "lateral," as used herein, means directed between or toward (or perpendicular to) the side of the crash cushion, for example the lateral direction 12, further defined below. The term "coupled" means connected to or engaged with, whether directly or indirectly, for example with an intervening member, and does not require the engagement to be fixed or permanent, although it may be fixed or permanent. The term "transverse" means extending across an axis, and/or substantially perpendicular to an axis. It should be understood that the use of numerical terms "first," "second," "third," etc., as used herein does not refer to any particular sequence or order of components; for example "first" and "second" connector segments may refer to any sequence of such segments, and is not limited to the first and second connector segments of a particular configuration unless otherwise specified.

Figure 1A:
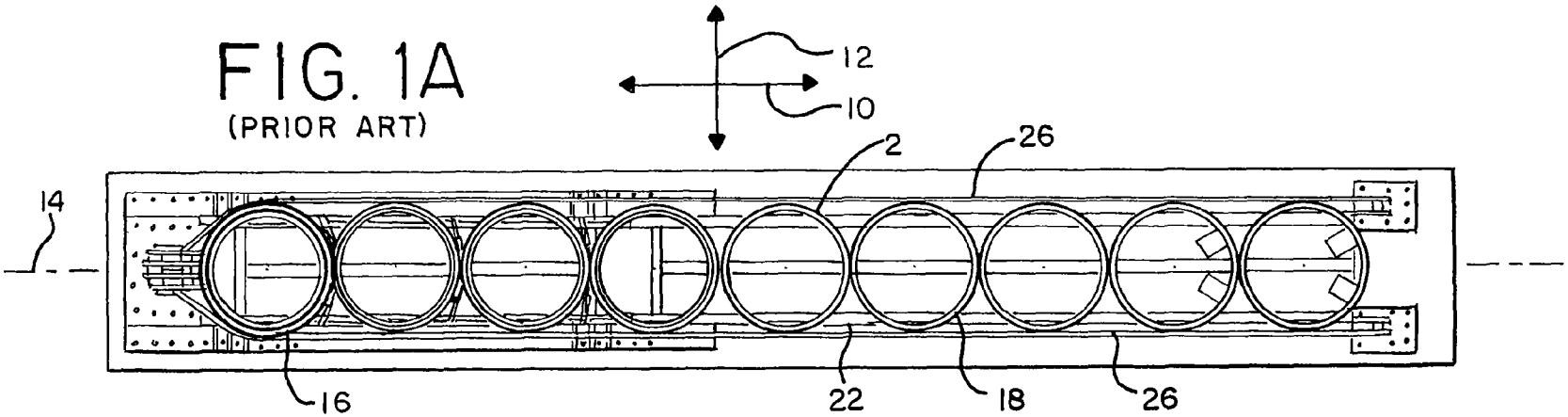
FIG. 1A (PRIOR ART)
FIGS. 1A and 1B are plan and side views, respectively, of a prior art REACT 350® Crash Cushion with a self contained backup.
Figure 1B:
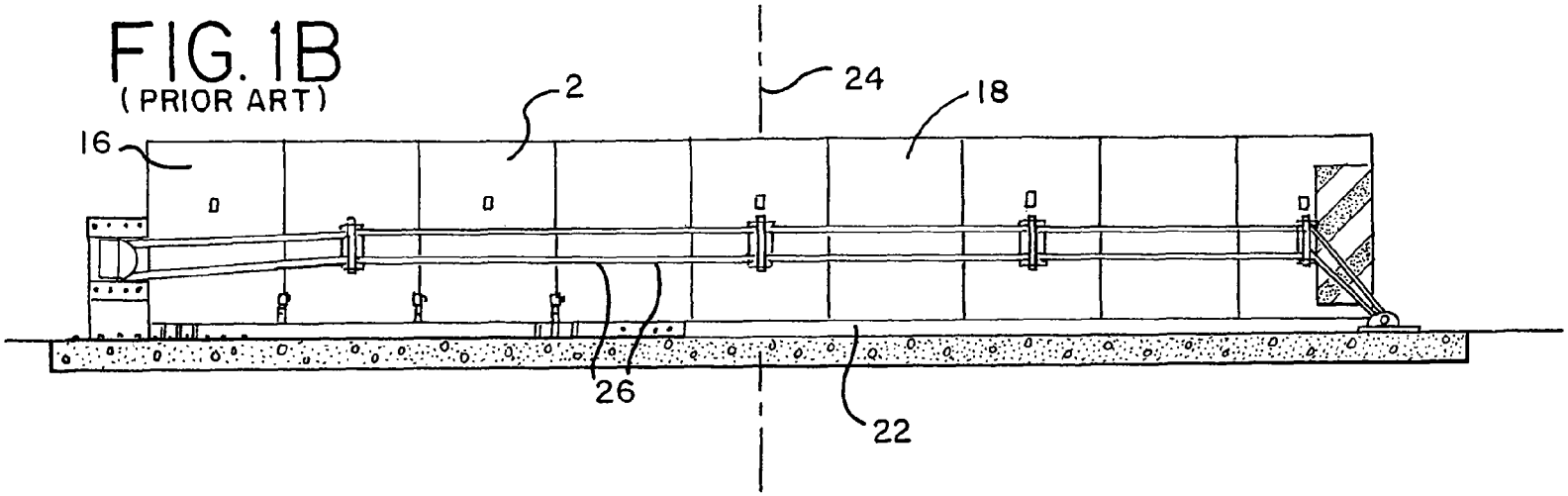
FIG. 1B (PRIOR ART)

As can be seen in FIGS. 1A and B, a prior art REACT® 350 crash cushion incorporates nine high density polyethylene (HDPE) tubes 2 (configured as cylinders) of varying thicknesses positioned along a longitudinal axis 14 extending in a longitudinal direction 10. It should be understood that the term "tubes" refers to a hollow, elongated structure, and may be configured in different shapes, including without limitation the disclosed cylindrical shape. The phrase "longitudinal direction" means an axial, end-on impact direction. The phrase "lateral direction" means a direction substantially perpendicular to the longitudinal direction, and refers to a side impact direction. During an end-on impact, the system dissipates the energy of the impacting vehicle as the cylinders collapse. Thicker cylinders 16 may be placed at the rear of the system to provide impact capacity for large vehicles, whereas thinner cylinders 18 may be placed at the front of the system to provide a soft initial impact force for smaller vehicles. Adjacent tubes are coupled to each other.

Referring to FIGS. 1A and B, 3 and 14-15, HDPE cylinders are supported by and coupled to rails 22 at the base of the system. In this embodiment, the tubes are oriented with a center axis 24 extending in a vertical direction. The interface between the cylinders and the rails 22 provides a redirective capability to vehicles that laterally impact the side of the system. In one embodiment, a shackle 252 is coupled to and slides along a rod (e.g., 1½ inch diameter). A chain 254 connects the shackle 252 and another shackle 260 and a plate 258 coupled between two adjacent cylinders (pairs 6 and 7, 7 and 8, and 8 and 9). The first five cylinders rest and slide along the base track rails, but are not directly coupled thereto. In addition, cables 26 are provided along the side of the system, and are anchored at the front and back of the systems, so as to provide additional redirective capabilities. Various aspects of this system are disclosed in U.S. Pat. No. 5,011,326, the entire disclosure of which is hereby incorporated herein by reference.

Figure 2:
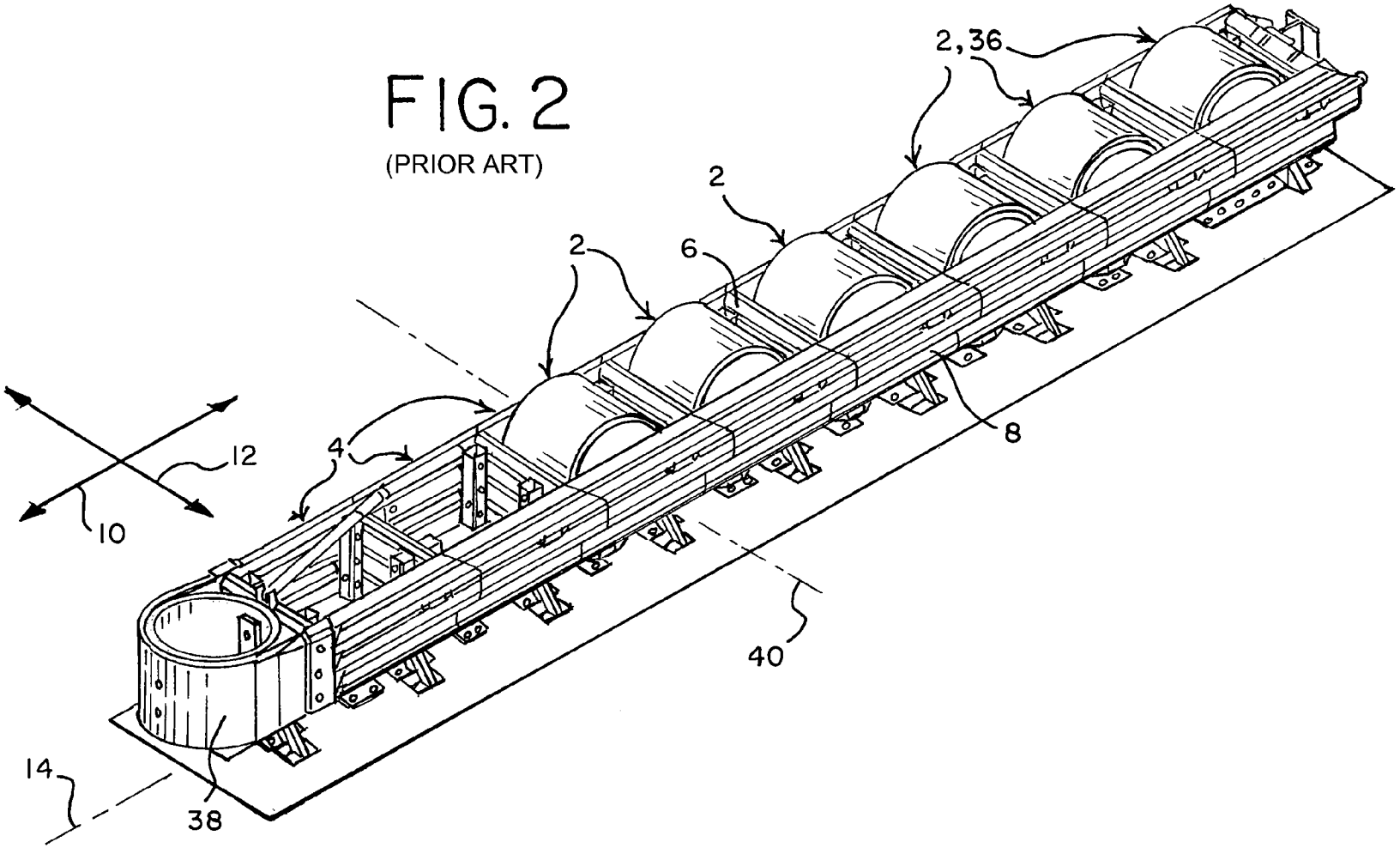
FIG. 2 (PRIOR ART)
FIG. 2 is a perspective view of a prior art QUADGUARD® ELITE 8-Bay Crash Cushion with a self contained backup.

Referring to FIG. 2, the prior art QUADGUARD® Elite system includes a metal framework of overlapping fender panels 8 attached to diaphragms 6. Bottom portions of the diaphragms are coupled to a centrally located rail that extends in a longitudinal direction 10. The fender panels 8 and diaphragms 6 define and form bays 4, shown as eight in this embodiment. A plurality of HDPE tubes 2, configured as cylinders, is disposed in the six (6) bays positioned at the rear of the system. In one embodiment, three energy absorbing modules 36 positioned at the rear of the system are configured with two HDPE tubes, one inside of the other, which creates a module that is effectively thicker, absorbing more energy during high capacity vehicle impacts. As shown in this embodiment, the tubes are oriented with a center axis 40 extending in a horizontal direction. An energy absorbing nose 38 on the front of the system is configured with a vertically mounted HDPE tube, configured as a cylinder. The first two bays of the system do not contain energy absorbing HDPE elements. This effectively softens the front of the system, allowing acceptable impact performance when the system is impacted on the nose by small vehicles, such as the small 820 kg test vehicle that is called for in NCHRP-350. During an end-on impact, the bays collapse, thereby compressing the energy absorbing HDPE tubes, safely bringing the vehicle to a stop. During a side impact, the steel fender panels 8 safely redirect the vehicle, while transferring the load to the diaphragms and then to the ground mounted rail.

Figures 3, 4, 5, 18:
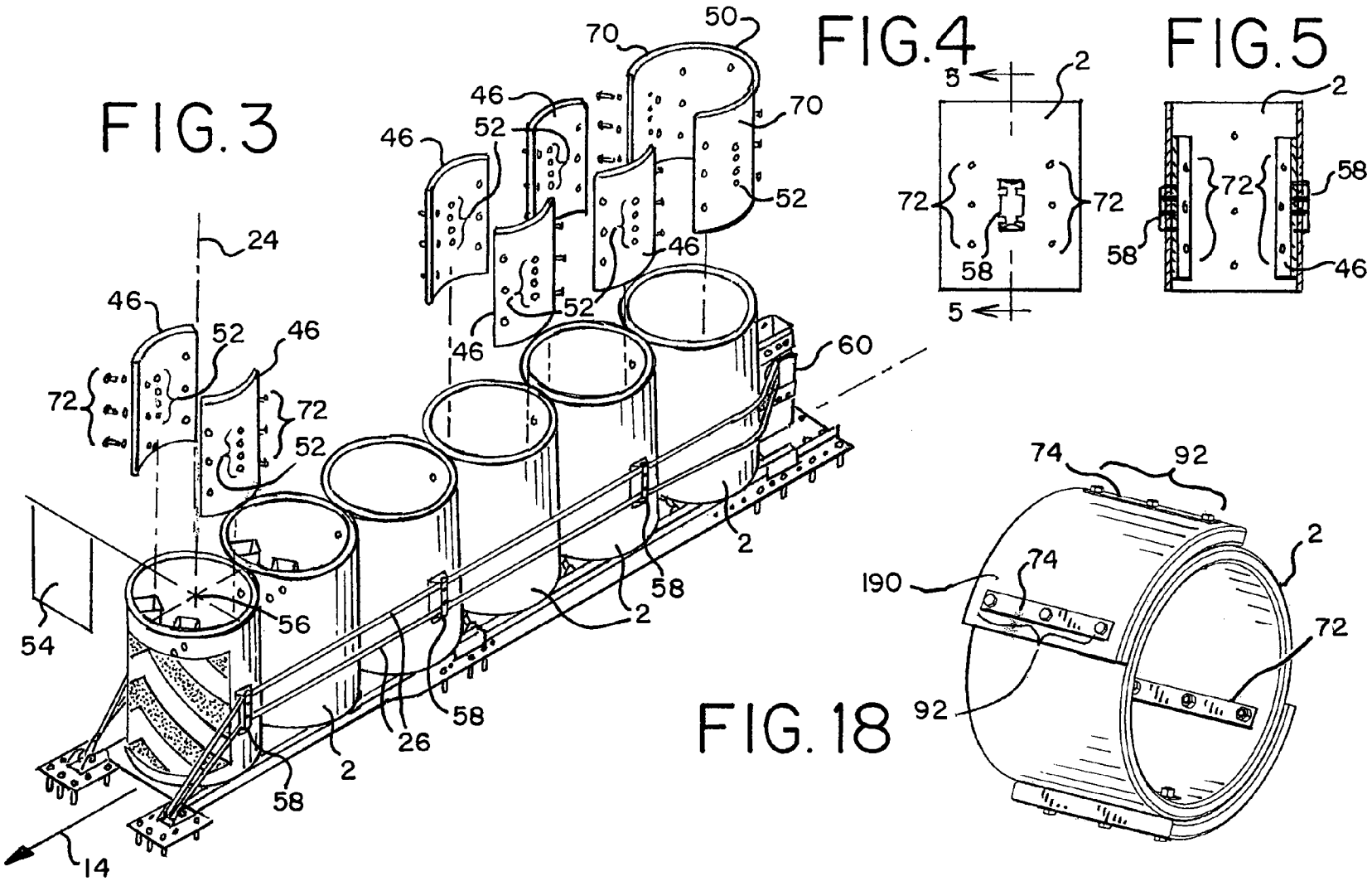
FIG. 3 is a partially exploded perspective view of a first embodiment of a crash cushion.
FIG. 4 is a side view of one of the tubes shown in FIG. 3.
FIG. 5 is a cross-sectional view of the tube shown in FIG. 4 taken along a diametral plane defined by line 5-5.
FIG. 18 is a perspective view of an alternative embodiment of a tube having a horizontally oriented axis configured with a segment.
Figure 14:
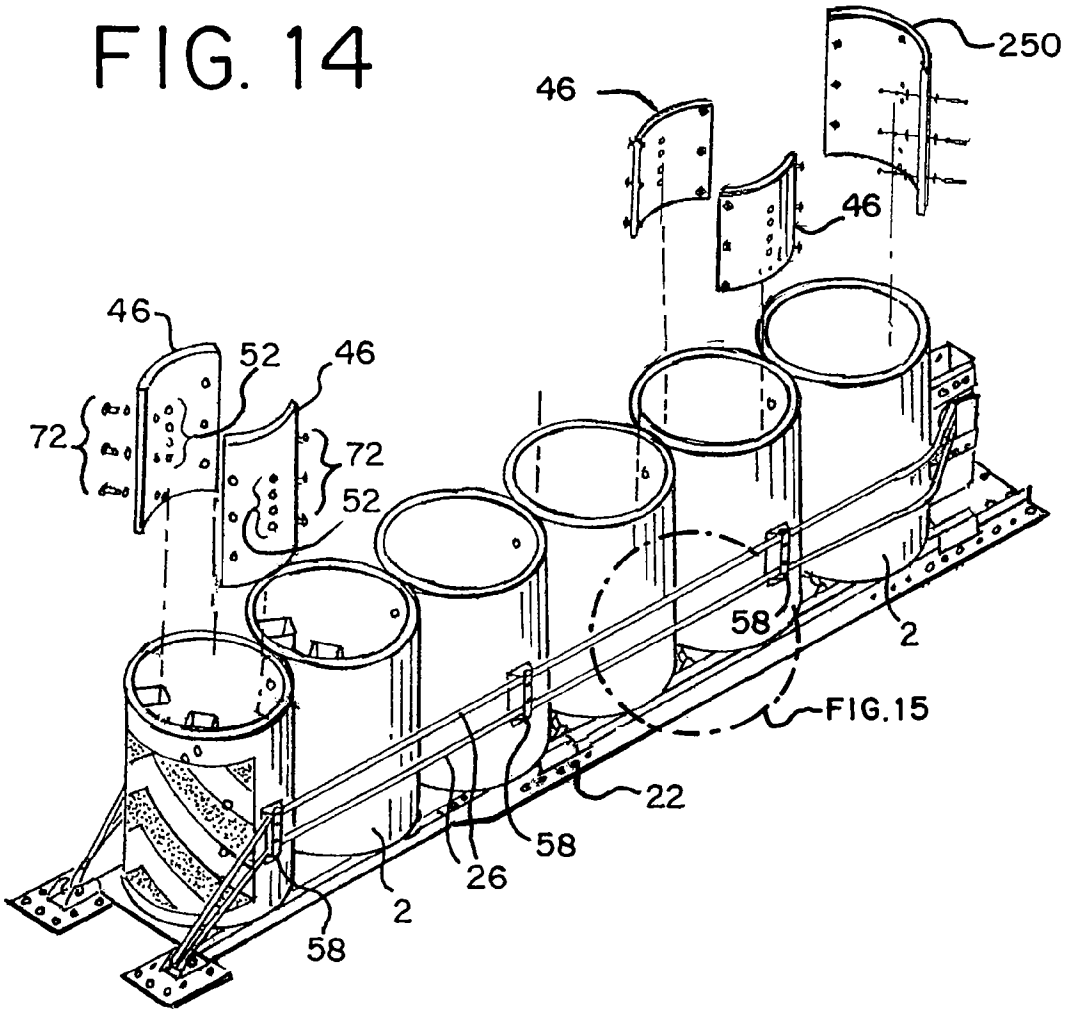
FIG. 14 is a partially exploded perspective view of a first embodiment of a crash cushion.

Referring to FIGS. 3-5, 9 and 14-17, various systems incorporating a plurality (shown as 6 in this embodiment) of HDPE tubes is shown. Pairs of tubes 3 and 4, 4 and 5 and 5 and 6 are tethered to a rod with chains and shackle as explained above, with the first two tubes sliding along the rails. It should be understood that other systems incorporating more or less tubes may also be suitable for various energy absorbing situations. The tubes 2 are spaced along the longitudinal axis 14, with adjacent tubes being coupled one to another with fasteners. As shown in FIG. 3, the system incorporates segments 46, 50, or pairs thereof, in the first, fourth, fifth and sixth tubes, all configured as cylinders in this embodiment. In the embodiment of FIG. 14, segments are incorporated into the first, fifth and sixth segments. In one embodiment, the segments 46, 50 are 1.4 inches thick by 24 inches in circumferential length by 36 inches in height. Pairs of segments 46 positioned in the first and fifth tubes are configured with four openings 52 positioned at the bend points, which correspond to the intersection of a diametral plane 54 passing through the center 56 of the tube 2 and lying substantially perpendicular to the longitudinal axis 14. The openings provide clearance for the mounting bolts that hold a pair of cable guides 58 in place, which in turn receive a pair of cables. The segments positioned in the fourth and sixth tubes may also be provided with holes 52 to provide similar energy dissipation characteristics. More or less holes may be provided in individual segments to "tune" such characteristics. It should be understood that segments may be positioned in all of the tubes, or in only one tube.

Figure 16:
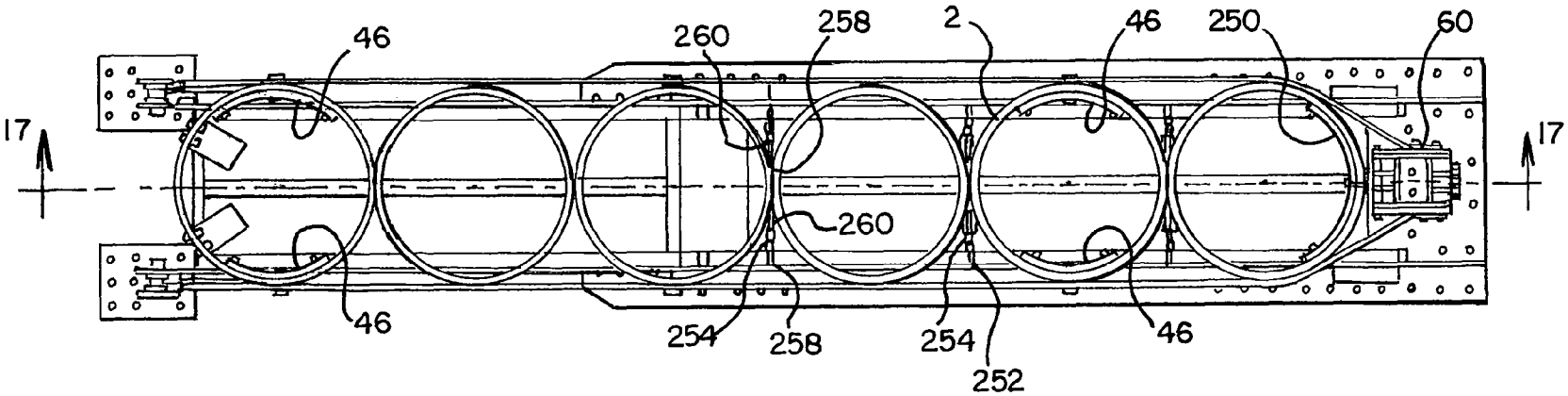
FIG. 16 is a top, plan view of the crash cushion shown in FIG. 14

In one embodiment, the first three tubes have a thickness of about 1 inch, while the last three tubes have a thickness of about 1.4 inches. The segments 46 have a thickness of about 1.4 inches, a circumferential length of about 25 inches and a height (axial length) of about 36 inches. Alternatively, as shown in FIG. 16, the segment has a height (axial length) of about 24 inches. The rear segment 70 has a circumferential length of about 76.25 inches. In this embodiment, the system is capable of meeting the NCHRP-350 testing standard at the TL-3 test level. It should be understood that the tubes and segments may be configured with other dimensional parameters (e.g., thickness, width and height) suitable for a particular energy absorbing configuration.

Figure 17:
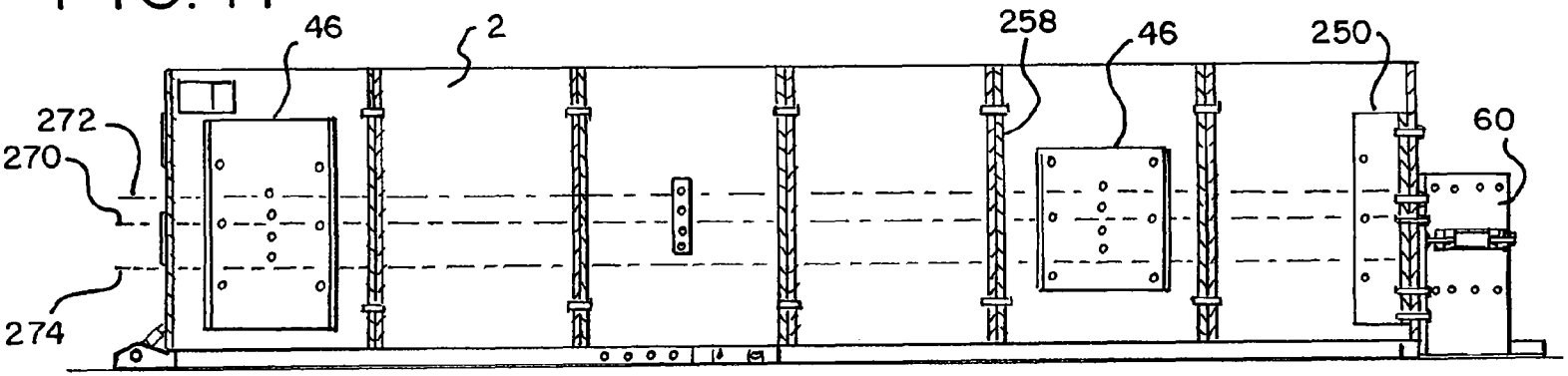
FIG. 17 is a cross-sectional view of the crash cushion shown in FIG. 15 taken along line 17-17.

To prevent, or reduce, the likelihood of the rearwardmost tube from wrapping around a backup structure 60, the segment 50 disposed in the sixth tube extends around the back of the system, thereby forming a C-shape, with end portions 48 thereof intersecting a diametral plane lying substantially perpendicular to the longitudinal axis 14. Preferably, the C-shaped segment 50 has a circumferential length less than the circumferential length of the interior periphery of the tube, such that the arc defined by the segment is greater than 0 but less than 360 degrees. Alternatively, as shown in FIGS. 14 and 16-17, the C-shaped segment 250 does not extend to the diametral plane lying perpendicular to the longitudinal axis, and is primarily directed to preventing wrap around with respect to the backup structure. In the embodiment of FIG. 3, the segment 50 is positioned symmetrically relative to a vertical plane running along the longitudinal axis.

A pair of segments 46 also is disposed in the first tube, such that the first tube imparts an impulsive load to an impacting vehicle before the vehicle's seat belts or airbags interact with its passengers. A reflective coating or member may be disposed over the front of the first tube. Because the passengers are at this point decoupled from the vehicle, a slightly higher loading can be tolerated without endangering the vehicle's occupants. The benefit to applying a slightly higher load at the front of the system is to ensure that the vehicle's airbag system senses the impact and properly deploys the airbags. In addition, the overall length of the crash cushion may be reduced. Similar technology has been used on other products, including those that were disclosed in U.S. Pat. Nos. 6,092,959 and 6,427,983, the entire disclosures of which are hereby incorporated herein by reference.

Referring to FIGS. 3-5, 9, 14 and 16-17, the HDPE segments 46, 50 are disposed along an interior surface 62 of the outer tube 2, with the interior of the tube being open, or free of any reinforcing structure, between opposing segments such that the tube 2 and segments 46, 50 may freely and fully collapse during an impact. In one embodiment, the segments are held in place by a plurality of fasteners, for example hex head bolts 64, washers 66 and nuts 68. One suitable embodiment provides for ½ inch-13×3 or 4 inch bolts. Alternatively, other mounting devices such as rivets, screws, adhesives/bonding agents, plastic welding, and etc. could be used to secure the segments to the tubes. In one embodiment, the pairs of segments 46 are coupled to the tube 2 on opposite sides of the interior surface 62. The opposing segments 46, or opposing end portions 70 of segment 50, intersect a diametral plane 54 containing the center axis 56 of the tube 2 and which lies substantially perpendicular to the longitudinal axis 14. The diametral plane defines the bend line of the tubes during a head-on axial impact.

The segments may be centered along a height of the tube, may have the same height as the tube, or may be offset so as to be closer to the bottom of the tube. For example, a 36 inch tall segment may have a bottom edge about 3.25 inches from the bottom edge of the tube, while a 24 inch tall segment may have a bottom edge about 9.25 inches above the bottom of the tube. As shown in FIG. 17, the horizontal centerlines 270 of the segments (24 and 36 inches in height) are positioned below a center of gravity (CG) 272 of a large test vehicle, but above the CG 274 of a small test vehicle, which minimizes the likelihood of an errant vehicle from vaulting or diving.

Each of the segments 46, or end portions 70, is symmetrically secured to the tube relative to the diametral plane 54. For example, and referring to FIGS. 3, 6, 7, 9, 14, and 16-17, two rows 72 of fasteners (3 per row) are spaced equidistance (L) from the diametral plane 54. Put another way, the fasteners 64, 66, 68 on each side form an angle $\alpha$ relative to the plane 54. In one embodiment, where the segment has a circumferential length of 24 inches, the outside arc length L is about 11 inches, or 22 inches between the rows of fasteners. In another embodiment, where the segment had a length of 12 inches, the distance (2 L) between the rows of fasteners was about 10 inches. The washers may also be configured as strips of metal 74, disposed on the outer surface of the tube and/or the inner surface of the segments, as shown for example in FIGS. 6-8. In alternative embodiments, shown for example in FIGS. 10 and 11, a single row of fasteners 76 may be disposed along the intersection of the diametral plane 54 with the tube 2 and segments 46, 70, which with the segments thereby being symmetrically secured to the tube relative to the plane 54. In other embodiments, a center row of fasteners may be provided, with other rows spaced circumferentially outwardly therefrom.

In one alternative embodiment, shown in FIG. 11, a plurality of segments 46, 80 may layered one on top of the other. For example, a pair of first segments 46 may be disposed on opposite sides of an interior surface 62 of the tube 2. A second pair of segments 80 is then secured to an inner surface of the first pair 46. In one embodiment, the segments are progressively shorter in circumferential length as they move radially inwardly toward the center of the tube 2. It should be understood that more than two layers may be provided.

Figure 12:
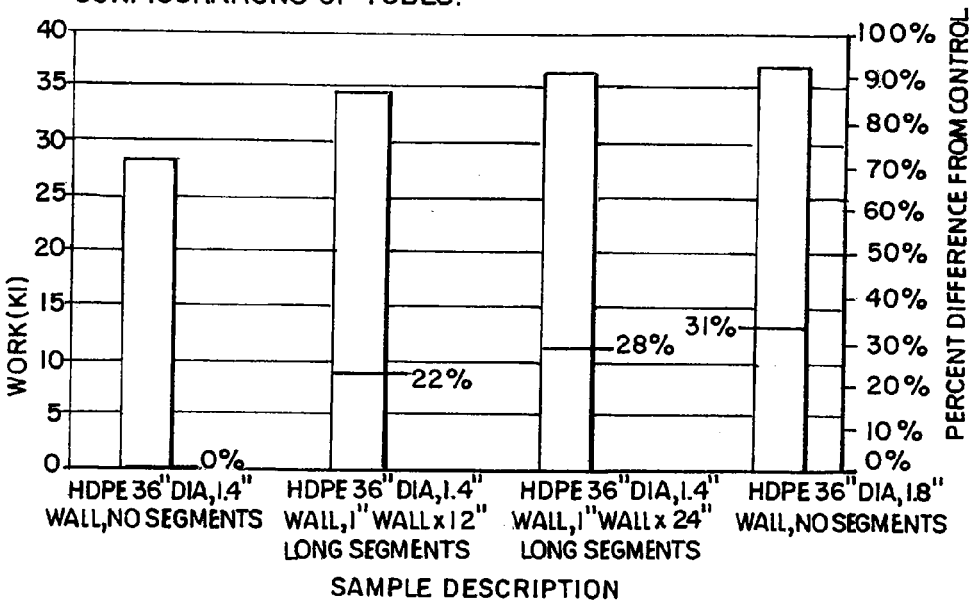
FIG. 12 is a graph depicting the energy absorption of a various configurations of tubes.

During an impact event, the tubes 2 collapse, thereby absorbing energy. The portion of the tube intersected by the diametral plane 54, and configured with segments 46 or end portions 70 undergoes the most deformation, straining the HDPE material at this location. The segments 46, 50 increase the energy absorption of the tube assembly, without the expense of increasing the thickness of an entirety of the primary tube. For example, another way to increase the energy absorption of a tube is to increase the wall thickness, e.g., to a thickness of 1.8 inches. FIG. 12 shows the differences between the energy absorption of various tube configurations, with and without segments, with the data being normalized to a cylinder height of 12 inches. As is shown in FIG. 12, a 1.4 inch thick tube that is 36 inches in diameter by 12 inches tall would absorb 28 kJ of energy. This same tube, when provided with a thickness of 1.8 inches, would absorb 37 kJ of energy. Increasing the cylinder thickness would also increase the weight of the cylinder from 70 lbs to 90 lbs. These numbers can be more easily compared by considering the energy absorbed per unit weight of material. Since material cost tends to be proportional to the amount of material (i.e. weight), this measure provides one indication of the cost efficiency of a design. In this example, the energy absorbed per pound of material goes from 0.40 kJ/lb to 0.41 kJ/lb, meaning that the 1.8 inch thick cylinders are 2.5% more cost efficient than the 1.4 inch thick cylinders.

In contrast, a 1.4 inch thick tube with 24 inch long segments that are 1.0 thick would absorb a total of 36 kJ of energy, resulting in an energy per unit of weight of 0.42 kJ/lb.

In this case, the tube with the segments has a cost efficiency that is 2.5% greater than the 1.8 inch thick tube alone and a total of 5.0% greater cost efficiency than the 1.4 inch thick tube alone. A 1.4 inch thick tube with 12 inch long segments that are 1.0 inch thick would have the best energy per unit of weight, with a value of 0.44 kJ/lb. This is a 10% improvement over the standard 1.4 inch thick tube alone.

At the same time, the 1.4 thick tube configured with a 1.0 inch thick segment undergoes less strain at the outer radial regions relative to a 1.8 inch thick tube. Less strain corresponds to less permanent deformation, meaning that the thinner material may rebound more easily to its original shape than the 1.8 thick tube.

Figure 13:
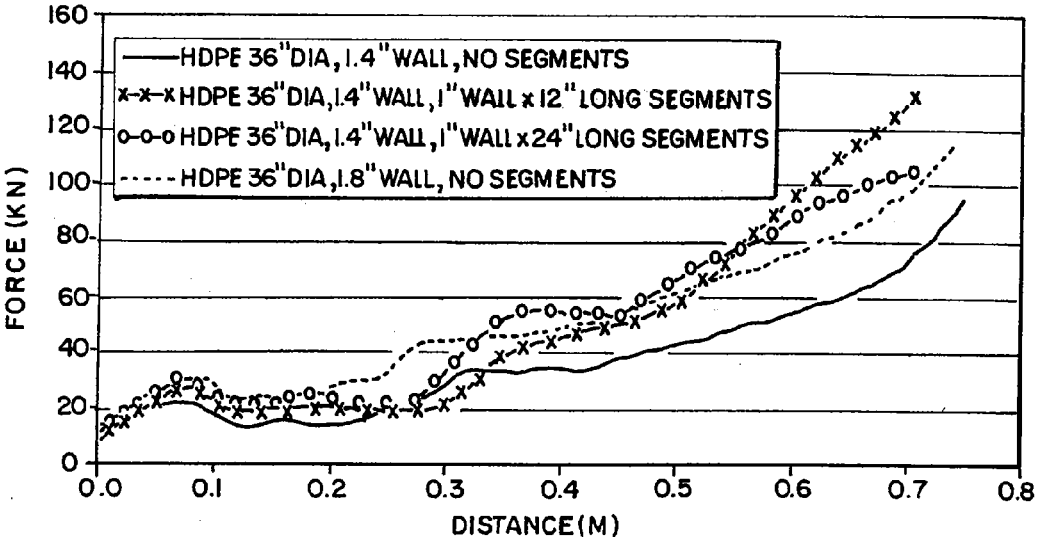
FIG. 13 is a graph depicting the Force v. Distance of various configurations of tubes.
Figure 15:
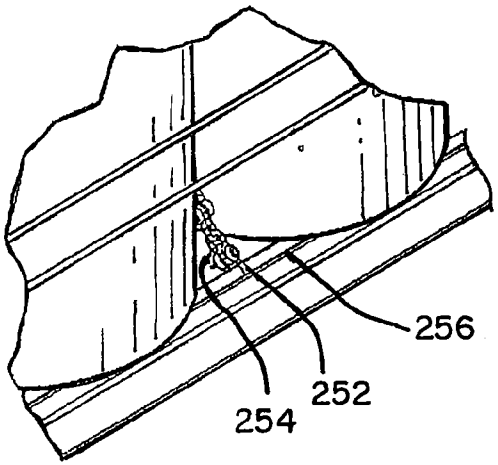
FIG. 15 is an enlarged, partial view of the crash cushion shown in FIG. 14 taken along detail line 15.

FIG. 13 shows the force deflection plots of four different tube configurations. The force levels of the four different tube configurations are little changed relative to each other until between 0.2 m and 0.3 m of deflection. At this point the plots start to diverge, with the 1.8 thick tube without segments demonstrating a higher force as compared to the 1.4 inch thick tube without segments. The 1.4 inch thick tube with 24 inch long by 1.0 thick segments ramps upwards above both the 1.4 thick and 1.8 thick cylinders configured without segments. Finally, the 1.4 inch thick tube with 12 inch long by 1.0 inch thick segments ramps higher than the other configurations after about 0.5 m of deflection. Since the total energy absorbed by the cylinders is the area under these curves, the higher the force loading of a particular curve, the greater the total energy absorption.

FIG. 13 reveals another advantage associated with the incorporation of segments. As noted earlier, the use of segments may result in greater cost efficiency over conventional tubes configured without segments. FIG. 13 demonstrates that the shape of the force deflection curve may also be modified by the design of the segments. For example, segments of 12 inches in length may result in the greatest cost efficiency of the various different designs. However as shown in FIG. 13, the force deflection curve for this design has a peak value of about 135 kN. Although this maximum force may be appropriate for some designs, there may be other designs that require a lower maximum force, so that the occupant risk values of an impacting vehicle are kept to appropriate levels. Lengthening the segments to 24 inches results in a peak force of about 104 kN, which may have a lower cost efficiency, but a greater energy absorption capacity of about 36 kJ.

Figures 6, 7, 8:
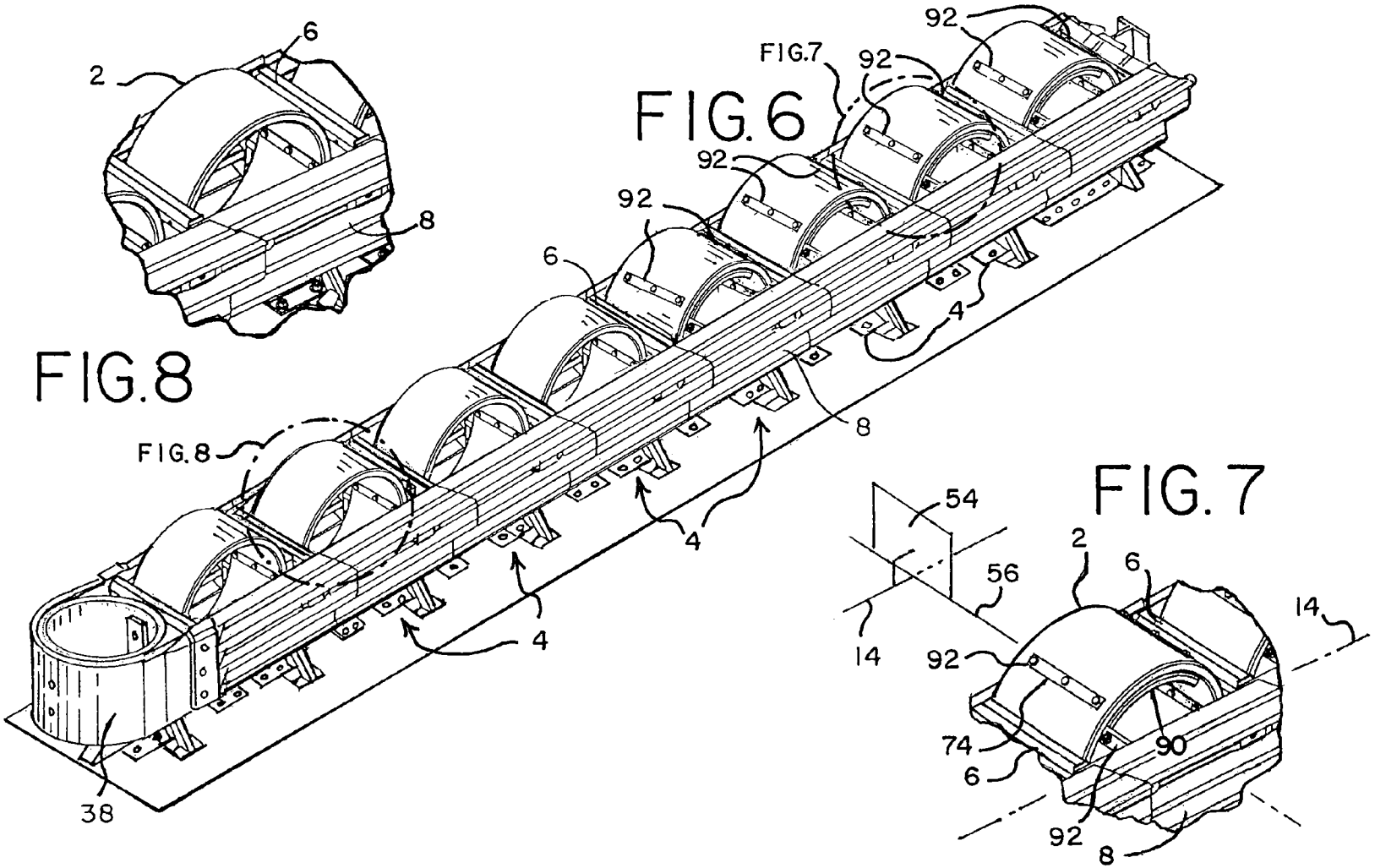
FIG. 6 is a perspective view of a second embodiment of a crash cushion.
FIG. 7 is an enlarged partial view of the crash cushion shown in FIG. 6 taken along detail line 7.
FIG. 8 is an enlarged partial view of the crash cushion shown in FIG. 6 taken along detail line 8.

Now referring to FIGS. 6-8, another embodiment of a crash cushion is shown. While this system may have the same overall length as prior systems (FIG. 2), the system is provided with increased energy absorption capacity. In one embodiment, HDPE segments 90 having a 1.65 inch thickness, by a 20 inch width and a 25 inch circumferential length are disposed inside HDPE tubes 2. As noted, the tubes 2 are oriented with a center axis 56 extending horizontally, but with the diametral plane being oriented in the same manner as previously disclosed. In essence, the tube assembly shown in FIG. 9 may be oriented either vertically, as shown in FIGS. 3-5, or horizontally, as shown in FIGS. 6 and 7, with the segments operating in the same way to increase the energy absorbing capacity of the corresponding tubes. Alternatively, as shown in FIG. 18, the segments 190 may be disposed on and coupled to the outside or exterior curved surface of the tubes oriented horizontally as shown in FIG. 6-8. In this embodiment, the exterior segments 190 are not exposed to the traffic. In one embodiment, the segments are 1.9 inches thick by 20 inches long, with a 32 inch diameter, and are disposed on a 28 inch diameter tube having a 1.65 inch thickness and a 20 inch length. As shown in FIG. 6, each of the eight bays 4 is provided with a tube 2, with the last four tubes each configured with a pair of segments 90. The tubes deployed in the first two bays accommodate a larger "small vehicle" called for in the MASH test standard as compared to the NCHRP-350 test standard. This somewhat larger vehicle requires the additional energy absorption provided by the tubes located in the first two bays. In one embodiment, the tubes in the last four bays are 1.9 inches thick by 20 inches wide with a 32 inch diameter, while the tubes in the first four bays are 1.9 inches thick by 15 inches wide with a 32 inch diameter. In one embodiment, the segments 90 are 1.65 inches thick, by 20 inches wide (axial length) and 25 inches long (circumferential length). The segments 90 are symmetrically coupled to an interior surface of the tubes relative to the diametral plane with two rows of fasteners 92, including washers 74. Of course, it should be understood that the segments 90 may be symmetrically coupled to the tubes with a single row of fasteners positioned along the intersection with the diametral plane 54.

As presented above, the use of segments 46, 50 and 90 greatly increases the tunability of HDPE energy absorbing tube assemblies. For example and without limitation, the circumferential length of the segments may affect the amount of the energy absorbed. As shown in FIG. 12, tubes configured with segments that are 12 inches in length, having fasteners spaced at 10 inches, absorb more energy than tubes configured with segments that are 24 inches in length with fasteners spaced at 22 inches. Since 12 inch segments also weigh less, they have greater cost efficiency. The circumferential length of the segments also affects the peak force and the shape of the force deflection curve.

The length of the segments parallel to the axis of the cylinder (i.e. "height" in reference to the embodiment of FIGS. 3-5 and "width" in reference to the embodiment of FIGS. 6-8) also was found to affect the total energy absorbed. The longer the segment the greater the energy absorbed, with the force deflection curve being scaled upwards by the same amount. The thickness of the segments also was found to affect the total energy absorbed. The thicker the segments the more energy absorbed, with the force deflection curve being scaled upwards by the same amount. Conversely, the thicker the segment the more likely the segment was to suffer permanent deformation.

Although reference is made herein to the tubes and segments being made of HDPE, it should be understood that other polymeric and rubber compounds, such as rubber or other plastics, may be used for the energy absorbing tubes and/or segments. Using different materials may affect the amount of energy absorbed, the shape of the force deflection curve, the peak force, and the ability of the cylinder assemblies to completely restore after an impact. The number, size, and location of holes 52 may also affect the stiffness of the segments and hence the amount of energy they absorb. The current preferred embodiment of the 6-cylinder system includes a total of four 1½" holes at the hinge points of the segments. These holes slightly reduce the stiffness of the segments and hence also slightly reduce their energy absorption. The force deflection curve is also scaled down by the same amount. The use of holes as a method for tuning allows slight variations of energy absorption in otherwise similar parts. The location and number of fastening devices 64, 92 may also affect the amount of energy absorbed, the shape of the force deflection curve, the peak force, and the ability of the cylinder assemblies to completely restore after an impact. For example, moving the existing bolts inwardly towards the diametral plane 54 may have the effect of shortening the effective length of the segments, thereby increasing the stiffness of the cylinder and increasing the total amount of energy absorbed. Including additional rows of bolts, or universal/continuous attachment such as with an adhesive, may have the affect of shortening the effective length, while also causing the cylinder/segment assembly to act more like a thicker walled cylinder, which may also increase the stiffness of the cylinder and the amount of energy absorbed thereby.

It should be understood that segments may be incorporated into crash cushions having arrays of tubes with more than one row of tubes, for example a system having a pair of laterally spaced rows of tubes, or a combination of a single row and a plurality of rows, or a triangular, rectangular or other shaped array. In each of these embodiments, at least some the tubes are longitudinally spaced, although not necessarily co-axially along a longitudinal axis. Rather, the tubes may be longitudinally and laterally spaced. In another embodiment, a single tube with segments may also be provided, with the single tube acting as a crash cushion, or with a plurality of such tubes being reconfigurable in various arrays.

Although the present invention has been described with reference to preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of the invention.

What is claimed is:

1. A crash cushion comprising:

a plurality of resilient, self-restoring tubes each having a center axis and comprising an interior surface, wherein at least some of said plurality of tubes are positioned such that respective ones of said center axes are spaced apart in a longitudinal direction, wherein said center axis of at least one of said tubes is substantially perpendicular to a longitudinal axis extending in said longitudinal direction, and wherein said at least one of said tubes defines a diametral plane intersecting and oriented substantially perpendicular to said longitudinal axis, wherein said center axis of said at least one of said tubes lies in said diametral plane; and at least a pair of resilient segments, wherein said segments of each of said pairs of segments are disposed on opposite sides of said interior surface of said at least one of said tubes and intersect said diametral plane, wherein each of said segments is symmetrically secured to said at least one of said tubes relative to said diametral plane, and wherein said at least one of said tubes is substantially open between said opposed segments and is free of any reinforcing structure positioned between said opposing segments.

2. The crash cushion of claim 1 wherein said center axis of said at least one of said tubes is substantially vertical.

3. The crash cushion of claim 1 wherein said center axis of said at least one of said tubes is substantially horizontal.

4. The crash cushion of claim 1 wherein said center axis of at least some of said tubes are spaced apart along and intersect said longitudinal axis.

5. The crash cushion of claim 1 wherein said plurality of tubes consists of six tubes longitudinally spaced and aligned along said longitudinal axis.

6. The crash cushion of claim 5 wherein at least three of said tubes are configured with said pairs of opposing segments.

7. The crash cushion of claim 1 wherein said interior surface of some of said plurality of tubes are exposed and free of any reinforcing structure on opposite sides of a diametral plane intersecting and oriented substantially perpendicular to said longitudinal axis, wherein said center axis of each of said at least some of said tubes lies in said diametral plane.

8. The crash cushion of claim 1 wherein said at least said pair of segments are made of high density polyethylene.

9. The crash cushion of claim 1 wherein each of said segments is secured to said tube with a pair of circumferentially spaced rows of fasteners arranged substantially symmetrical relative to said diametral plane.

10. The crash cushion of claim 1 wherein each of said segments is secured to said tube with a row of fasteners arranged substantially along said diametral plane.

11. The crash cushion of claim 1 wherein said at least one tube has a thickness of less than or equal to about 1.4 inches, and wherein said segments have a thickness of less than or equal to about 1.0 inches.

12. The crash cushion of claim 1 wherein each of said segments has a length of less than or equal to about 24 inches.

13. The crash cushion of claim 1 wherein at least another one of said tubes comprises a C-shaped segment secured to said interior surface thereof, wherein said C-shaped segment is substantially symmetrical to a vertical plane extending along said longitudinal axis, and wherein opposing end portions of said C-shaped segment intersect a diametral plane intersecting and oriented substantially perpendicular to said longitudinal axis, wherein said center axis of said at least another one of said tubes lies in said diametral plane.

14. The crash cushion of claim 1 wherein each of said segments has a length less than an inner circumference of said at least one of said tubes.

15. A crash cushion comprising:

a plurality of resilient, self-restoring tubes each having a center axis and comprising an interior surface, wherein at least some of said plurality of tubes are positioned such that respective ones of said center axes are spaced apart in a longitudinal direction, wherein said center axis of at least one of said tubes is substantially perpendicular to a longitudinal axis extending in said longitudinal direction, and wherein said at least one of said tubes defines a diametral plane intersecting and oriented substantially perpendicular to said longitudinal axis, wherein said center axis of said at least one of said tubes lies in said diametral plane; and at least one resilient segment, wherein portions of said at least one resilient segment are disposed on opposite sides of said interior surface of said at least one of said tubes, wherein each of said portions of said at least one segment is symmetrically secured to said at least one of said tubes relative to said diametral plane, and wherein said at least one of said tubes is substantially open between said opposed portions of said at least one resilient segment and is free of any reinforcing structure positioned between said opposing segments.

16. The crash cushion of claim 15 wherein said center axis of said at least one of said tubes is substantially vertical.

17. The crash cushion of claim 15 wherein said center axis of at least some of said tubes are spaced apart along and intersect said longitudinal axis.

18. The crash cushion of claim 15 wherein said interior surface of some of said plurality of tubes are exposed and free of any reinforcing structure on opposite sides of a diametral plane intersecting and oriented substantially perpendicular to said longitudinal axis, wherein said center axis of each of said at least some of said tubes lies in said diametral plane.

19. The crash cushion of claim 15 wherein said at least one segment is made of high density polyethylene.

20. The crash cushion of claim 15 wherein said at least one segment comprises a C-shaped segment secured to said interior surface thereof, wherein said C-shaped segment is substantially symmetrical to a vertical plane extending along said longitudinal axis, and wherein said portions are formed by end portions of said C-shaped segment.

21. The crash cushion of claim 15 wherein each of said portions is secured to said tube with a row of fasteners arranged substantially along said diametral plane.

22. The crash cushion of claim 15 wherein said at least one segment has a length less than an inner circumference of said at least one of said tubes.

23. A crash cushion comprising:

a plurality of resilient, self-restoring tubes each having a center axis and comprising an interior surface, wherein at least some of said plurality of tubes are positioned such that respective ones of said center axes are spaced apart in a longitudinal direction, wherein said center axis of at least one of said tubes is substantially perpendicular to a longitudinal axis extending in said longitudinal direction, and wherein said at least one of said tubes defines a diametral plane intersecting and oriented substantially perpendicular to said longitudinal axis, wherein said center axis of said at least one of said tubes lies in said diametral plane; and at least one C-shaped resilient segment disposed in a rearwardmost tube, wherein said segment intersects said longitudinal axis and has a length less than an inner circumference of said rearwardmost tube.

* * * * *